United States Patent [19]

Griffith et al.

[11] Patent Number: 4,764,142

[45] Date of Patent: Aug. 16, 1988

[54] PORTABLE STAGE STRUCTURE AND KIT

[76] Inventors: Marlene J. Griffith, 6019 Creek Ridge Ct., Minnetonka, Minn. 55345; Mary E. Heinlein, 721 W. 96th St., Chaska, Minn. 55318

[21] Appl. No.: 59,747

[22] Filed: Jun. 8, 1987

[51] Int. Cl.[4] ..... A63J 19/00; A63J 1/02; A63H 33/00; E04H 15/04

[52] U.S. Cl. ..... 446/82; 446/487; 135/90; 135/96; 272/22; 160/59; 160/81

[58] Field of Search ..... 446/82, 487, 488, 83, 446/84, 478, 901; 135/96, 90, 900, 901; 272/22, 23, 21, 9; 160/81, 59, 56, 45

[56] References Cited

U.S. PATENT DOCUMENTS

| | | | |
|---|---|---|---|
| 351,860 | 11/1886 | Glidden | 135/90 X |
| 836,296 | 11/1906 | Bitner | 446/478 |
| 1,076,653 | 10/1913 | Keyte | 272/22 |
| 1,102,595 | 7/1914 | Knight | 272/10 |
| 1,587,134 | 6/1926 | Anton | 160/56 |
| 2,327,147 | 8/1943 | Worthington | 160/56 |
| 2,834,150 | 5/1958 | White | 446/82 X |
| 3,397,710 | 8/1968 | McElroy | 135/90 X |
| 3,528,086 | 9/1970 | Conger | 135/900 X |
| 3,812,611 | 5/1974 | Bierwiler | 272/22 X |
| 3,839,816 | 10/1974 | Fischereder | 446/82 |
| 3,899,168 | 8/1975 | Besherse | 272/21 |
| 4,435,915 | 3/1984 | Zaruba et al. | 446/478 X |
| 4,449,542 | 5/1984 | McSwain et al. | 135/98 |

FOREIGN PATENT DOCUMENTS

| | | | |
|---|---|---|---|
| 1292057 | 2/1962 | Fed. Rep. of Germany | 272/22 |

*Primary Examiner*—Richard J. Johnson
*Assistant Examiner*—D. Neal Muir
*Attorney, Agent, or Firm*—Leo Gregory

[57] ABSTRACT

A children's portable stage structure embodying a changeable pictorial scene setting outer curtain, an inner closure curtain, and a canopy removably extending the stage structure outwardly of a supporting wall surface.

4 Claims, 2 Drawing Sheets

PORTABLE STAGE STRUCTURE AND KIT

BACKGROUND OF THE INVENTION

1. Field of Invention

This invention relates to a small sized portable collapsible stage structure.

2. Description of the Previous Art

Portable stages such as puppet stages are known in the art, such as the doorway mounted curtain in U.S. Pat. No. 2,834,150 to N. M. White, a bar is supported across the intersection of two walls to drape a curtain system in U.S. Pat. No. 3,839,816 to F. Fishereder. A pedestal supported umbrella puppet stage is shown in U.S. Pat. No. 3,899,168 to S. Besherse.

It is desirable to have a portable wall supported stage structure with depth and changeable stage curtains providing a variety of stage settings.

SUMMARY OF THE INVENTION

This invention relates to a portable stage for use by children which is readily erected. The stage is collapsible and is carried in a cylindrical container and is removed from its container and draped into operating position by merely being hung from a nail or hook on a wall and side arms extend outwardly from the wall projecting a canopy and hanging the stage front which consists of an opening in a curtain panel through which the youthful actors make their presentation. Changeable outer curtains may depict scenes with reference to the character of the plays and an inner draw curtain serves to close the stage front.

A stage structure herein is readily useable in classrooms, recreational rooms or in a child's room for the enactment by children of appropriate plays wherein a child within the playhouse setting given may exercise simulated fancy.

It is an object to provide a portable stage structure which may be rolled up into a compact form for storage or to be carried. To be put into an operating position, the stage structure is merely removed from a sleeve like container and hung from a hook or nail on a wall as has been indicated.

It is a further object herein to provide a portable stage structure which is comprised of flexible material forming a canopy having a floor length front wall suspended from a front cross rod and a pair of side arms suspend the structure projected forwardly of a supporting wall surface, and embodying a stage setting curtain panel.

These and other objects and advantages of the invention will be set forth in the following description made in connection with the accompanying drawings in which like reference characters refer to similar parts throughout the several views.

DESCRIPTION OF A PREFERRED EMBODIMENT

Figures 1, 2, 3:
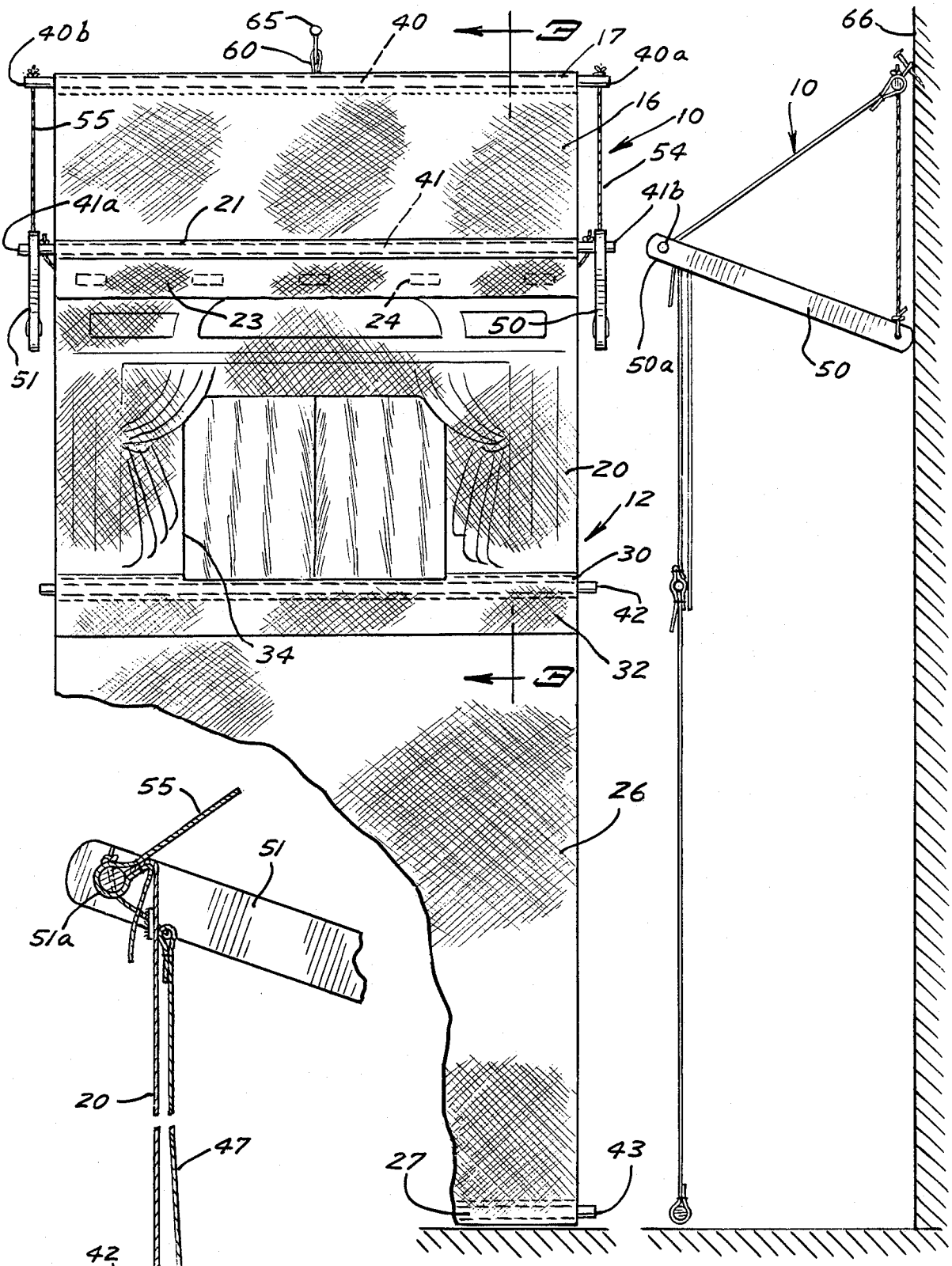
FIG. 1 is a front elevational view with a portion thereof being broken away.
FIG. 2 is a view in side elevation.
FIG. 3 is a broken view in vertical section taken on line 3—3 of FIG. 1 as indicated.

With reference to the drawings and particularly to FIGS. 1 and 2, the structure 10 comprising the invention herein is a portable stage structure.

The basic member of said stage structure is a segmented sheet member 12 which is made to include various elements of the stage structure and yet be conveniently handled as a single integral piece of material. Said sheet may be made of any material suitable for the purpose.

Said sheet member 12 has an upper panel of segment 16 formed across its upper end portion as a canopy. Depending from said canopy is an intermediate panel 20. A loop 21 is formed across the juncture of said panels 16 and 20. Said loop is readily formed by doubling a fold of the material and stitching thereacross.

Figure 5:
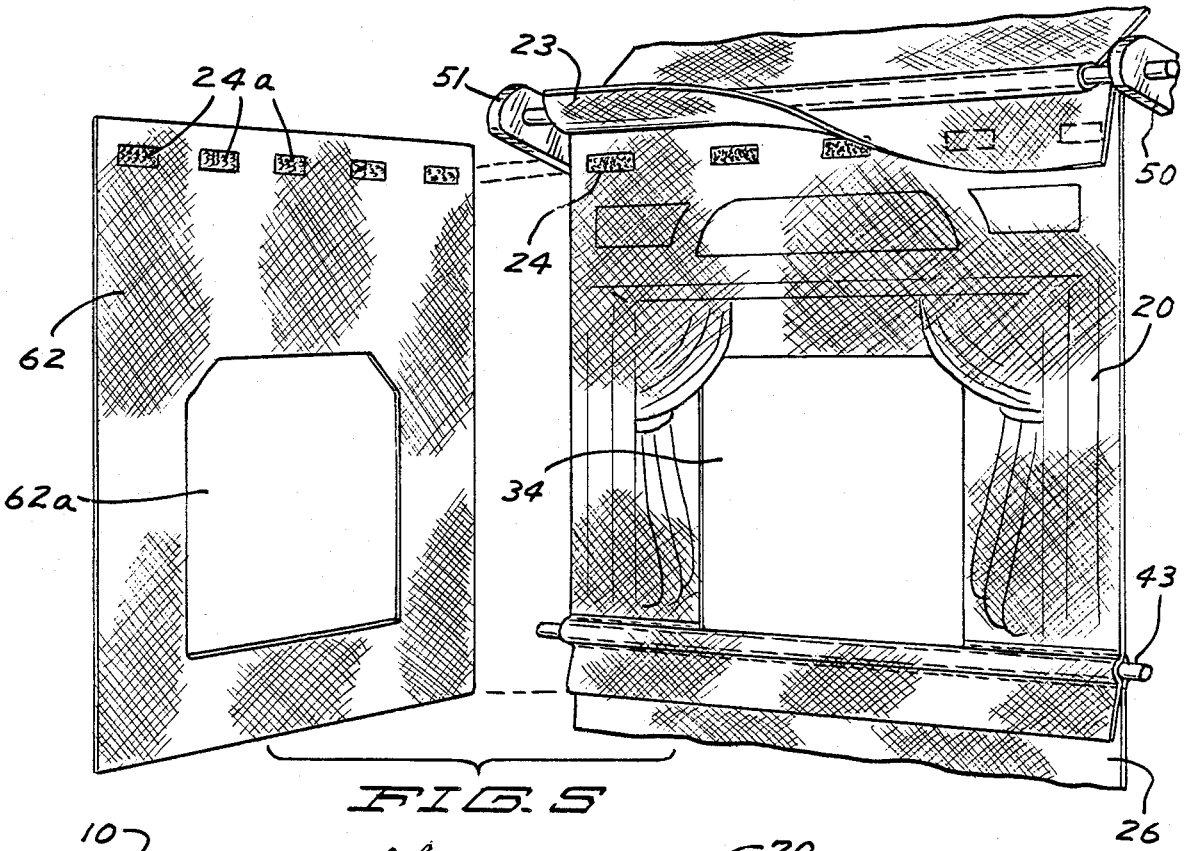
FIG. 5 is a front perspective view of the upper half of the structure with a portion thereof in exploded position.
Figure 6:
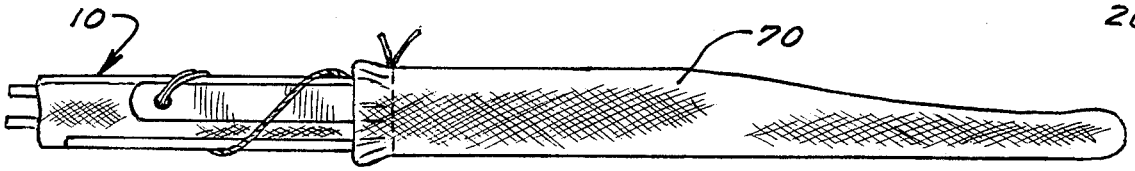
FIG. 6 shows the structure in side elevation collapsed in a rolled up condition partially within a container.
Figure 7:
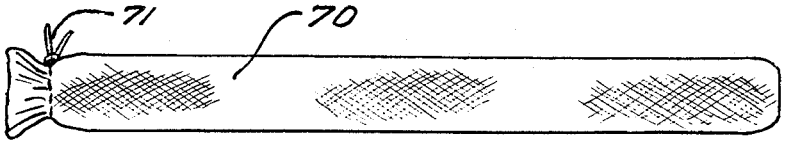
FIG. 7 shows in side elevation the structure herein within a container.

Depending from the front side of said loop is a flap, as well shown in FIG. 5. Underlying said flap and attached to said panel spaced across the width of said panel are a plurality of fastening members 24 here shown to be velcro pads.

A floor length panel 26 depends from said panel 20 and has a loop 27 formed across its bottom edge. A loop 30 is formed at the juncture of said panels 20 and 26 and depending from said loop is a flap 32.

The panel 20 forms the stage portion of the structure having a central cut out portion 34 framing the stage opening extending down to the loop 30 and being spaced from the top of said panel. Said panel preferably will be decorated about said opening to pictorially carry out the theme of the stage presentation being given.

To stiffen said sheet member 12 transversely, rod members such as dowel sticks are disposed through said loops described. A rod 40 extends through the loop 17, a rod 41 extends through the loop 21, a rod 40 extends through the loop 30 and a rod 43 extends through the bottom loop 22. The use of loops and dowel sticks merely illustrate a convenient form of means to transversely stiffen said sheet member 12.

Figure 4:
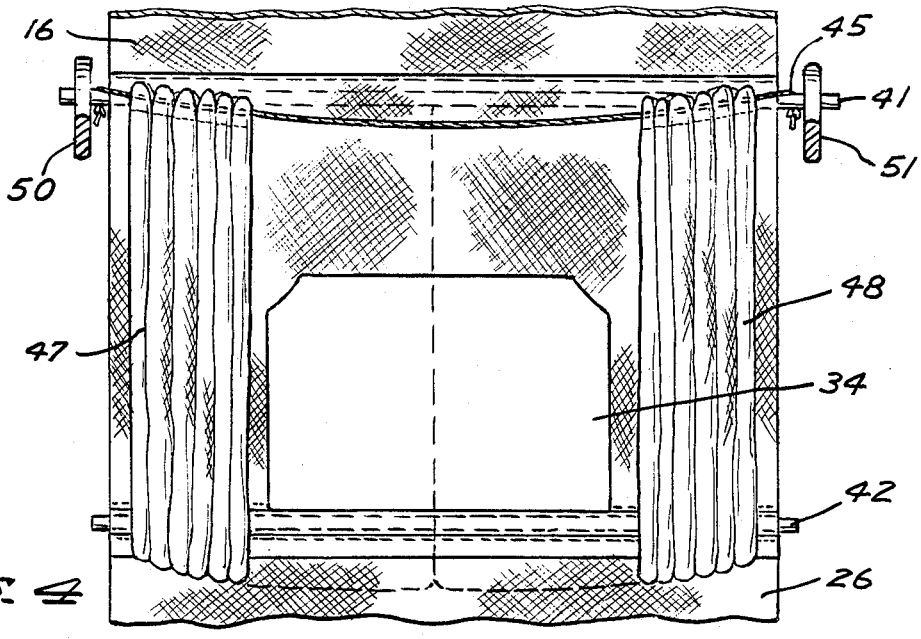
FIG. 4 is a broken rear elevational view showing the upper half of the structure.

Across the rear of the loop 21, FIG. 4, a string 45 is extended fastened to the end portions of the rod 41 and hung on said string are panels 47 and 48 forming a stage curtain for the closure of said opening 34.

The rod 41 at each of its ends will extend outwardly of said loop 21 as at 41*a* and 41*b*. Arms 50 and 51 are provided apertured at their forward ends 50*a* and 51*a* to receive therethrough respectively said rods ends 41*a* and 41*b*. Said arms at their other or rear ends 50*b* and 51*b* are respectively secured by suitable cords 54 and 55 to the corresponding ends 40*a* and 40*b* of said rod 40 to be suspended therefrom. Said cords will be of lengths to permit said arms preferably to be angled downwardly rearwardly.

A loop 60 is secured to an upper end portion of said sheet 12.

With the arm members 50 and 51 disposed crosswise of said sheet, the sheet is merely rolled up in collapsed position and disposed of into a sleeve 70 and tied as at 71 for transport or storage.

Upon removal from the sleeve 70, the sheet 12 is unrolled and the loop 60 is hung onto a hook or bracket 65 secured to a wall 66. The arms 50 and 51 are pivoted onto the ends of the rod 41 and are extended rearwardly to abut said wall.

Said cords 54 and 55 suspend said arms 50 and 51 as shown in FIG. 2.

Thus it is seen that in merely being hung onto a hook by said loop 60, the arms project the canopy forwardly away from said wall and the panels 20 and 26 drape downwardly and thus the stage structure is given depth and is quickly erected.

The panel 20, as described, is a stage front and depicts a stage curtain scene about the opening or cut out portion 34 therein. Other panels such as panel 62 may overlie said panel 20 having a corresponding opening 62*a* therein. Said panel 62 will have attached across the upper portion thereof velcro pads 24*a* which will mate with the pads 24 to be removably secured thereto. Said pads are covered by the flap 23. Thus the panel 62 and others like it may be used to overlie the panel 20 to provide a theme setting for the presentation being given and thus may be set the mood for the young thespians to act out their respective roles. Such scenes are not here shown.

It is seen that there is ample room for several actors to assemble behind the sheet 12 and present their efforts through the opening 34.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. A portable stage structure, having in combination an elongated sheet member having top and bottom edge portions, an uppermost portion of said sheet member forming a canopy, an intermediate portion of said sheet member forming a stage front, transverse stiffening members disposed respectively across the top and bottom edge portions of said sheet member and across the top of said intermediate portion, holding means spaced across said sheet member adjacent the top of said intermediate portion, a panel forming a stage front overlying said intermediate portion of said sheet member depicting a stage front scene, and means removably securing said panel to said holding means.

2. The structure of claim 1, including an alternate panel depicting an alternate stage front scene overlying said panel, and means removably securing said last mentioned panel to said first mentioned panel.

3. The structure of claim 1, wherein said holding means and said removable securing means comprise mating velcro strips.

4. A portable stage structure, having in combination an elongated sheet member having a top edge forming a loop, an uppermost portion of said sheet member comprising a canopy, an intermediate portion of said sheet member depending from said canopy comprising a stage front, a transverse stiffening member across said top edge of said sheet disposed through said loop, a transverse stiffening member across the top of said portion comprising said stage front, an opening in said stage front, a closure means for said opening, a pair of elongated arms each being pivoted at one end to an end of said second mentioned transverse member, flexible means suspending each of the other ends of said arms from corresponding ends of said first mentioned transverse member, said intermediate portion of said sheet having fastening means thereacross, and alternate panels forming stage fronts are removably secured to said fastening means providing a variation in stage front scenes.

* * * * *